US005241764A

United States Patent [19]

Modig

[11] Patent Number: 5,241,764

[45] Date of Patent: Sep. 7, 1993

[54] BUCKET ASSEMBLY WITH SCREENING FUNCTION

[76] Inventor: Clifford Modig, Pl 9505, S-82100 Bollnäs, Sweden

[21] Appl. No.: 920,464

[22] PCT Filed: Jan. 18, 1991

[86] PCT No.: PCT/SE91/00037

§ 371 Date: Aug. 19, 1992

§ 102(e) Date: Aug. 19, 1992

[87] PCT Pub. No.: WO91/14051

PCT Pub. Date: Sep. 19, 1991

[30] Foreign Application Priority Data

Mar. 6, 1990 [SE] Sweden ..... 9000787-3

[51] Int. Cl.[5] ..... E02F 3/407

[52] U.S. Cl. ..... 37/405; 37/901; 414/725

[58] Field of Search ..... 37/117.5, DIG. 2; 414/725, 726, 724, 912

[56] References Cited

U.S. PATENT DOCUMENTS

| | | | |
|---|---|---|---|
| 2,501,489 | 3/1950 | Aisthorpe | 37/DIG. 2 X |
| 3,003,265 | 10/1961 | Lutjens | 37/118 |
| 3,630,396 | 12/1971 | Womack | 414/725 |
| 3,765,490 | 10/1973 | Logue | 37/118 R |
| 3,904,052 | 9/1975 | Nordstrom | 37/117.5 X |
| 5,172,498 | 12/1992 | Wach | 37/103 |

FOREIGN PATENT DOCUMENTS

| | | |
|---|---|---|
| 2114933 | 12/1972 | Fed. Rep. of Germany . |
| 2540905 | 8/1984 | France . |
| 165844 | 6/1955 | Sweden . |

*Primary Examiner*—Dennis L. Taylor
*Assistant Examiner*—Arlen L. Olsen
*Attorney, Agent, or Firm*—McAulay Fisher Nissen Goldberg & Kiel

[57] ABSTRACT

A bucket assembly comprising a bucket member connectible to a bucket stick (7) and having two side walls (6, 6'), a curved wall, and a bottom wall (4) forming an extension of the latter, as well as a screening member (2) articulated to the bucket member (1). The screening member (2), which advantageously is a grid structure, has, like the bucket member, two side walls (10, 10'), a curved wall (11) extending therebetween, and a bottom wall (12), these walls having the same contours as the corresponding walls of the bucket member. The screening member is arranged, in an inoperative position, to be maintained inside the bucket member with its walls in close proximity to the corresponding walls of the bucket member, and, in an operative position, to be maintained outwardly pivoted from the bucket member to allow a fine fraction of material to pass freely through the holes of the walls or the grid structure.

11 Claims, 3 Drawing Sheets

BUCKET ASSEMBLY WITH SCREENING FUNCTION

FIELD OF THE INVENTION

This invention concerns a bucket assembly with screening function, comprising a bucket member connectible to at least one pivotable operating arm on a vehicle and having, in addition to two side walls and a curved wall extending therebetween, a bottom wall forming an extension of said curved wall between said side walls and having a free forward edge adapted to dig into the material to be collected in the bucket assembly; as well as a screening member connected to the bucket member by joints at the upper part of the curved wall and pivotable in relation to the bucket member between an inoperative position and an operative position in which material collected by the assembly can be sorted into a fine fraction passing through the screening member, and a coarse fraction remaining therein.

DESCRIPTION OF THE PRIOR ART

SE Patent Specification 165,844 discloses a bucket assembly of this type, in which the screening member is a grid structure of minute dimensions compared with the bucket member. This grid structure is attached to the ends of two long and curved pivot arms whose opposite ends are articulated to the upper portion of the curved wall of the bucket member. The inoperative position of the grid structure is an upwardly pivoted position in which the pivot arms extend in a substantially vertical direction upwards from the upper edge of the bucket member, while the operative position of the grid structure is a downwardly pivoted position close to the front edge of the bottom wall of the bucket member. Thus, the grid structure is raised when material is taken up in the bucket assembly, and lowered in the area before the front edge of the bucket bottom wall when the material that has been taken up is screened.

This prior art bucket assembly suffers from the serious disadvantage that the grid structure forming the screening member in its inoperative raised position not only obstructs the view between the driver's cab on the vehicle carrying the bucket assembly and the area in front of the bucket, but also hinders the movements of the bucket in different loading situations, e.g. when the bucket is situated on a low level relative to the vehicle. It should also be observed that this bucket assembly is only intended and suited for loading, more precisely front loading, of loose earth and other bulk materials, and not for digging in e.g. tightly-packed earth or stones.

DE 2,114,933 also discloses a similar bucket assembly suffering from essentially the same disadvantages.

SUMMARY OF THE INVENTION

This invention aims at obviating the disadvantages of prior art bucket assemblies of the type described above by providing a bucket assembly in which the screening member in its inoperative position is wholly and completely out of the way, thus enabling an unobstructed view between the driver's cab and the bucket member and allowing free operation of the bucket member also in complicated work situations. Further, the screening member, in its inoperative position, is effectively protected from the particularly severe stresses arising when the assembly is used for digging in tightly-packed stony ground. According to the invention, this is achieved in that the screening member, like the bucket member, has two side walls, a curved wall extending therebetween, and a bottom wall, at least the two last-mentioned walls being formed with holes or openings for allowing the fine fraction of the material to pass through, and having the same contours as the corresponding walls of the bucket member, said screening member, in its inoperative position, being maintained inside the bucket member with its walls in close proximity to the corresponding walls of the bucket member, and, in its operative position, being maintained outwardly pivoted from the bucket member to allow the fine fraction of the material to pass freely through its apertured walls.

The invention is primarily intended for use together with buckets, i.e. buckets of the type which is mounted at the free end of the stick of an excavator and, more precisely, has a toothed free edge or lip on the bottom wall, facing rearwards to the machine proper so that, during digging, the downwardly opening bucket is swung downwards from above. However, the invention may also be applied to simple loading buckets for front loading.

FURTHER ELUCIDATION OF THE PRIOR ART

FR 2,540,905 disclosed a bucket assembly comprising a screening member which, in its inoperative position, is folded back against a bucket-like member. The latter, however, which mostly resembles a curved dozer blade, has no kind of bottom wall or lip whatsoever. The screening member is instead equipped with a whole bottom plate which, in the folded inoperative position, forms a bottom wall which defines a load-receiving bucket space together with the bucket-like member. Screening is carried out by a screen extending between the rear edge of the bottom plate and the upper edge of the bucket-like member and being uncovered by unfolding of the screening member. In this bucket assembly, which in actual practice can be used only for loading loose bulk material and not for digging in hard ground, the screening member proper is subjected to the stress from the material taken up, which calls for strong joints between the bucket-like member and the screening member.

Unlike the assembly of FR 2,540,905, the invention is based on the use of a screening member which, in its inoperative position, is entirely retracted into a surrounding bucket member and protected therein so that the heavy bucket member alone takes up the stresses arising during digging or loading.

Further, U.S. Pat. No. 3,765,490 discloses a bucket assembly comprising a bucket and a screening member which both are shaped as cylinder halves, the screening member being rotatable between an inoperative position inside the bucket member and an operative position turned through 180°, in which it covers the opening of the bucket member. It is true that the screening member of this assembly in its inoperative position is contained in the bucket member, but the fact that it has to be rotatable complicates the construction to such an extent that it becomes more difficult to use. Inter alia, special space-requiring housings are needed on the outside of the bucket member to accommodate a transmission for the rotation of the bucket member. These housings make it impossible to use the assembly for digging. In addition, the grid-shaped screening member cannot be moved into close and stress-free engagement with the inside of the bucket member unless both members have been manufactured with high precision, and this makes the construction very expensive.

The inventive assembly requires no outward housings on the side walls of the bucket member, and the screening member can, since it is pivotable and not rotatable relative to the bucket member, be moved into close engagement with the inside of the bucket member without requiring fine manufacturing precision.

DESCRIPTION OF THE PREFERRED EMBODIMENT

Figure 1:
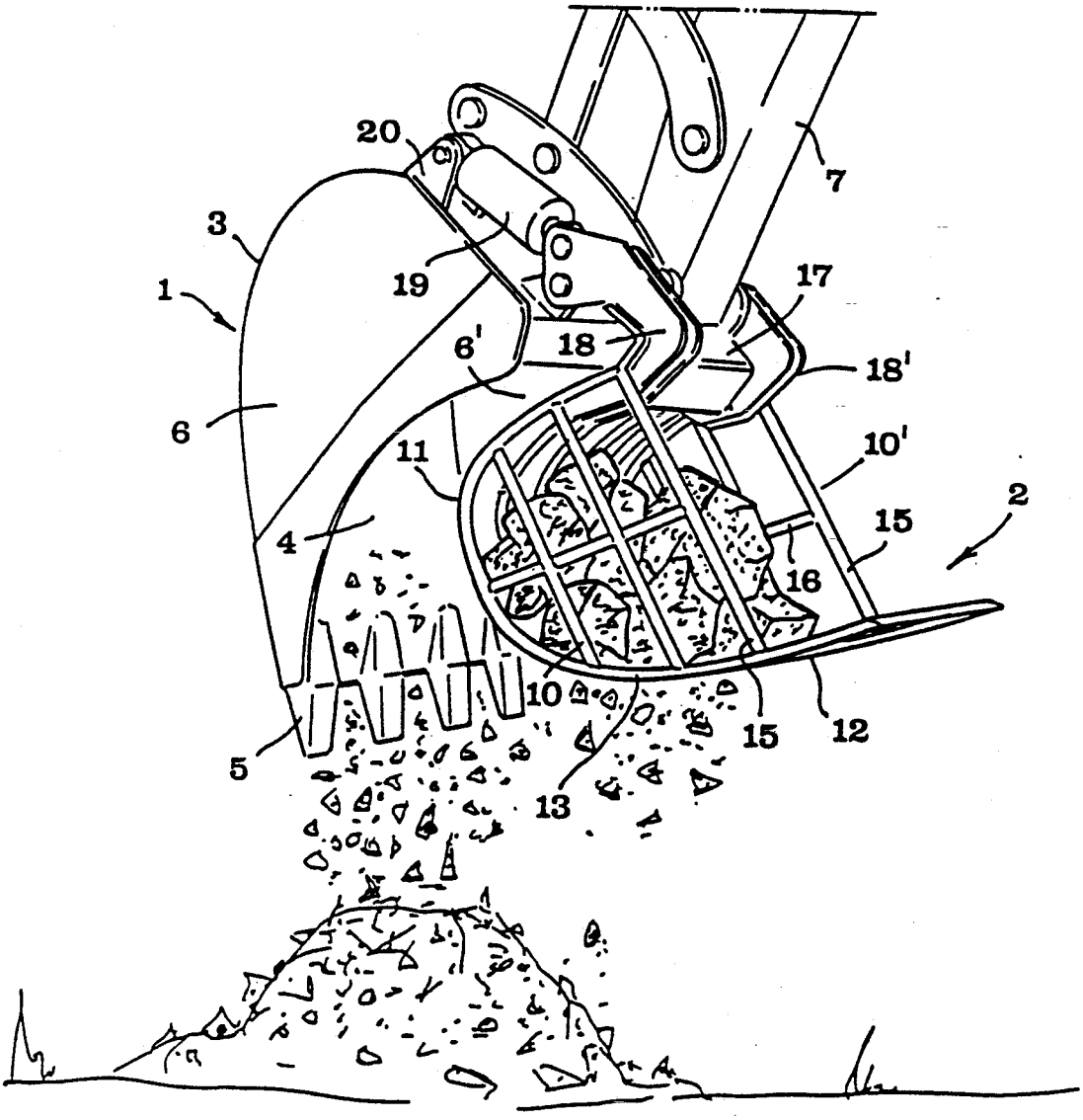
FIG. 1 is a perspective view of an inventive bucket assembly screening earth.

The bucket assembly shown in the drawings comprises a bucket member 1 and a screening member 2 articulated thereto. In all essentials, the bucket member 1 is a conventional bucket. Thus, the bucket member 1 comprises a rear curved wall 3 which at the bottom merges into a substantially flat bottom wall or lip 4 which, at a front lip, has a suitable member of digging teeth 5. Each wall 3, 4 is connected to side walls 6, 6', thus forming a scoop-shaped structure in which the material, such as earth, can be taken up. The bucket member 1 is, in conventional manner, mounted on the stick 7 of an excavator (not shown) in such a manner that it is pivotable about a pivot pin 8 on the stick 7 with the aid of at least one hydraulic cylinder 9.

Figure 4:
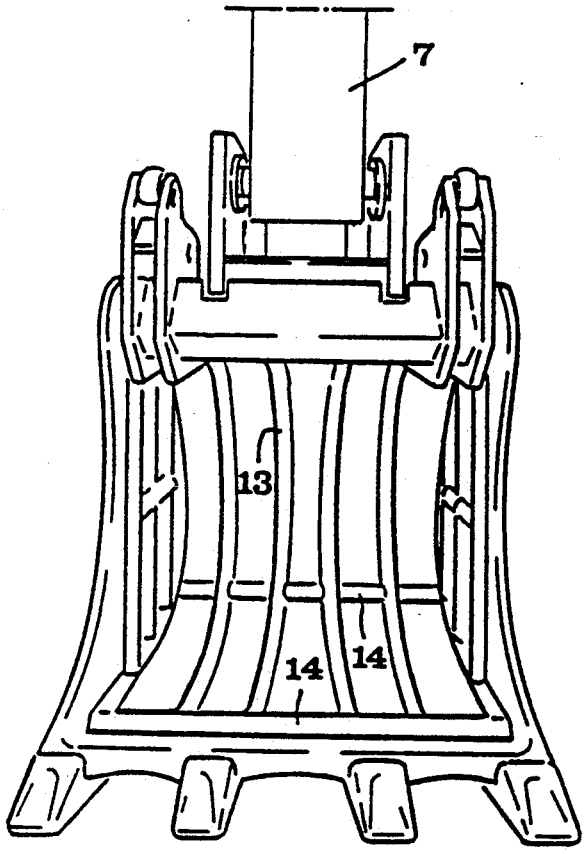
FIG. 4 is a front view of the assembly of FIGS. 1-3 with retracted screening member.

Like the bucket member 1, the screening member 2 has two side walls 10, 10', a curved wall 11 extending therebetween, as well as a bottom wall 12 extended from said curved wall. The walls 10, 10', 11 and 12 have essentially the same contours as the corresponding walls 6, 6', 3 and 4 of the bucket member 1, such that the general appearance of the screening member essentially corresponds to that of the bucket member, although the screening member is somewhat smaller than the bucket member and thus may be contained therein. At least the walls 11 and 12 of the screening member must be formed with holes or openings in order to let through the fine fraction of the material to be sorted. In the embodiment shown, the curved wall 11 and the bottom wall 12 extended therefrom are made as, or form part of, a continuous grid structure. More precisely, the grid structure comprises a number of separate, curved and longitudinal bars 13 (see FIG. 4) which are rigidly interconnected by a suitable number of transverse bars 14, one of which is positioned at the front, free edge of the bottom wall. Also the two side walls 10, 10' may advantageously be grid structures, more precisely in the form of a number of spaced-apart longitudinal bars 15 which are rigidly interconnected by one or more cross bars 16 and which, at their opposite ends, are attached to the outer bars 13 of the first-mentioned grid structure.

Figure 2:
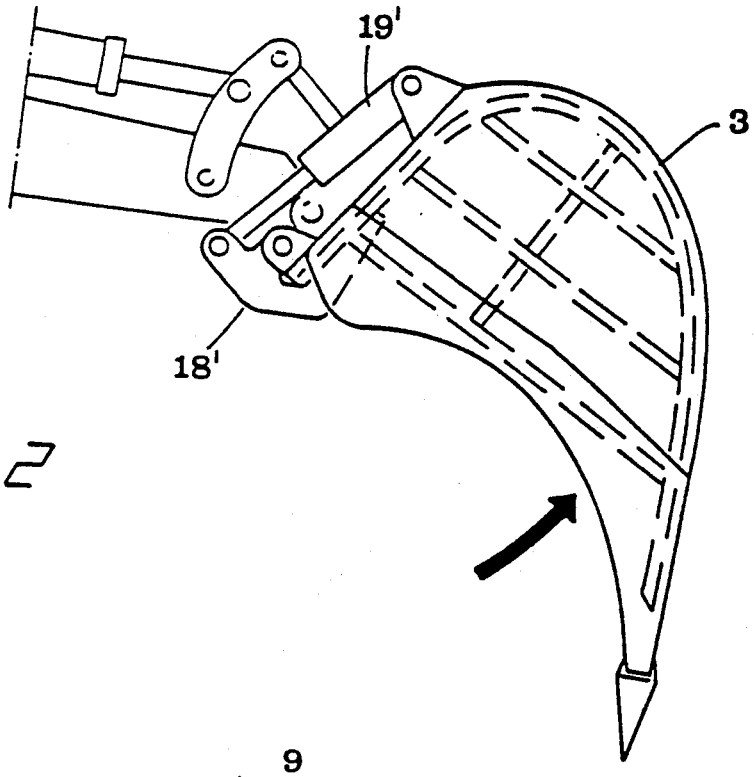
FIG. 2 is a side view of the assembly with retracted screening member.
Figure 3:
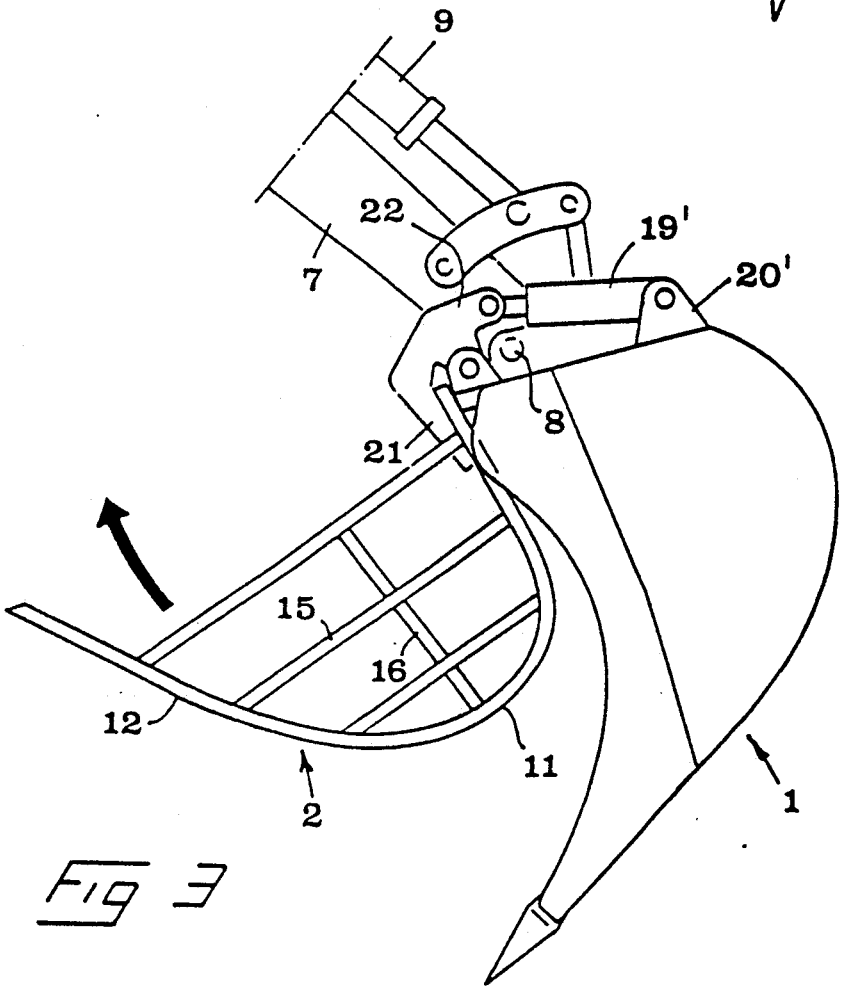
FIG. 3 is a similar side view showing the screening member extended from the bucket member.

The screening member 2 forming a continuous grid structure is mounted on an attachment in the form of a box girder 17 or the like which is turnable in relation to the bucket member 1 and on which are arranged two spaced-apart lugs 18, 18' which are articulated to the ends of hydraulic cylinders 19, 19' whose opposite ends are articulated to analogous lugs 20, 20' on the outside of the bucket member. The lugs 18, 18' are specially designed in so far as they have two shanks 21, 22 (see FIG. 3) which extend at an acute angle to one another, the rear wall 11 of the screening member forming an extension of the shank 21, and the hydraulic cylinder 19, 19' being, in a manner of speaking, an extension of the shank 22. Since the shank 21, owing to the special design of the lugs, can be inwardly pivoted to a position close to the rear wall 3 of the bucket member 1, the screening member can, when the cylinders 19, 19' are maximally extended, be pivoted in its entirety into the bucket member to the position shown in FIG. 2. By contraction or shortening of the cylinders 19, 19', the screening member is pivoted out of the bucket member, at least to the position shown in FIG. 3.

The bucket assembly described operates as follows. In tightly-packed ground full of stones, the earth is dug up in conventional manner with the bucket 1, the screening member 2 being maintained inside the bucket in the position shown in FIG. 2, in which the screening member or grid structure is closely applied to the inside of the bucket. In this position, the bucket can dig into the ground without being hindered by the screening member and without any appreciable stress being applied to the screening member, since this member is applied against and supported by the solid bucket. After the desired amount of earth has been dug out of the ground, the bucket is raised slightly from the ground, whereupon the screening member 2 is pivoted out of the bucket member 1 to the position shown in FIG. 1. This separates the bucket member from the screening member and uncovers all the walls of the screening member, so that the fine fraction of the earth which has been taken up can drop through the openings of the grid structure, while the coarse fraction in the form of stones remains in the screening member.

During the screening or sorting operation, the bucket assembly can be maintained e.g. in the area above a road to which the fine fraction of the material taken up is to be applied. When screening is completed, the assembly is moved to the side of the roadway and the coarse fraction of stones is emptied. In this manner, the inventive bucket assembly immediately and in simple and expedient manner sorts the material dug up when breaking a new road or restoring an already existing road.

Naturally, the inventive bucket assembly can be used in other ways, e.g. by one of the two fractions being loaded on a vehicle, while the other fraction is left in the area of the excavator or is loaded on another vehicle. Screening may be carried out as illustrated in FIG. 1, i.e. the bucket member 1 is maintained in a retracted position in which the fine fraction is allowed to drop directly onto the ground or another underlying structure. In actual practice, it is, however, preferred that the bucket member be maintained in a vertical position under the screening member when screening is to take place. In this manner, the fine fraction is collected by the bucket member and can be deposited where suitable, whereupon the coarse fraction is removed from the screening member in a final step. This mode of operation makes it possible to start screening immediately after the digging has been completed, even while simultaneously moving the bucket assembly sideways.

Figure 5:
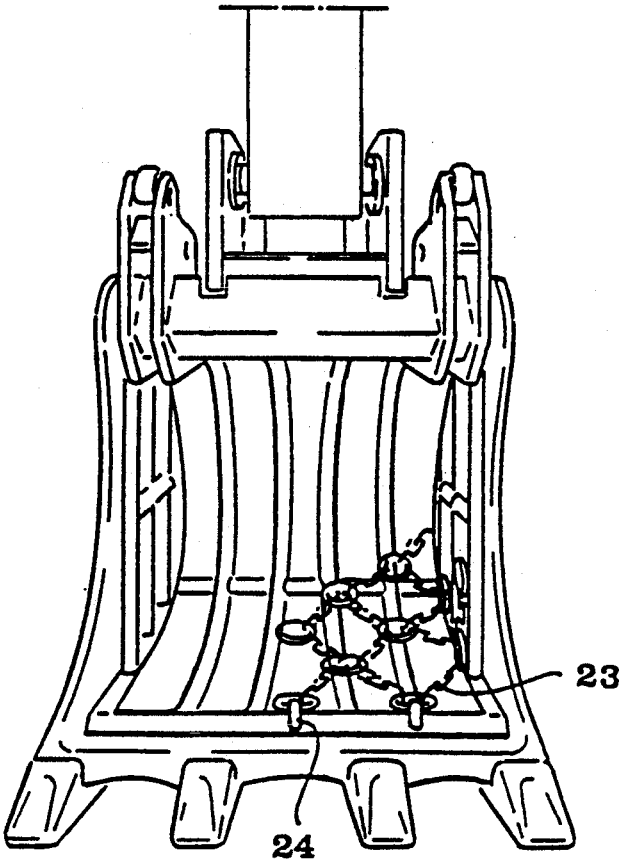
FIG. 5 is a front view similar to FIG. 4, illustrating an alternative embodiment of the invention.

FIG. 5 shows how the screening member made in form of a grid structure can be equipped with a flexible network mat 23 applied to the inside of the screening member. In actual practice, the flexible mat may advantageously be a chain mat of the type used as anti-skid device on forest machinery and comprising a number of chain sections which are interconnected by rings and together form a checked pattern. Such a chain mat can be attached to e.g. hooks 24 at the front and rear edges of the screening member. The provision of such a chain mat makes it possible to reduce the size of the openings in the grid structure so that a finer fraction is obtained in screening that would have been the case without a chain mat. Thus, it is possible to control the particle size of the fine fraction obtained in screening, by using chain mats with different-sized meshes.

Instead of flexible mats of this type, it is, of course, possible to add, to the rather coarse grid structure shown, other units, such as bars (in particular transverse bars) reducing the size of the openings of the grid structure.

Further, it would be observed that the bucket assembly shown can be equipped with one or more vibrators to facilitate screening of earth that is difficult to sort, e.g. frozen or sticky earth, if this cannot be done by jolting the grid structure when screening is carried out.

I claim:

1. A bucket assembly with screening function, comprising a bucket member (1) connectible to at least one pivotable operating arm (7) on a vehicle and having, in addition to two side walls (6, 6') and a curved wall (3) extending therebetween, a bottom wall (4) forming an extension of said curved wall between said side walls and having a free forward edge adapted to dig into the material to be collected in the bucket assembly; as well as a screening member (2) connected to the bucket member by joints at an upper part of the bucket member and pivotable in relation to the bucket member between an inoperative position and an operative position in which material collected by the bucket member can be sorted into a fine fraction passing through the screening member, and a coarse fraction remaining therein, characterised in that the screening member (2), like the bucket member, has two side walls (10, 10'), a curved wall (11) extending therebetween, and a bottom wall (12), at least the bottom wall and curved wall (11, 12) being formed with holes or openings for allowing the fine fraction of the material to pass through, and having the same contours as the corresponding walls of the bucket member, said screening member, in its inoperative position, being maintained inside the bucket member with its walls in close proximity to the corresponding walls of the bucket member, and, in its operative position, being maintained outwardly pivoted from the bucket member to allow the fine fraction of the material to pass freely through its apertured walls.

2. The bucket assembly of claim 1, characterised in that the curved wall (11) of the screening member (2) and the bottom wall (12) forming an extension of said curved wall are made as or form part of a continuous grid structure.

3. The bucket assembly of claim 2, characterized in that each side wall (10, 10') of the screening member (2) is in the form of a grid structure.

4. The bucket assembly of claim 2, characterized in that the screening member (2) is mounted on an attachment in the form of a box girder (17) which is turnable relative to the bucket member (1) and on which are arranged two spaced-apart lugs (18, 18') articulated to the ends of hydraulic cylinders (19, 19'), the opposition end of which are articulated to analogous lugs (20, 20') on the outside of the bucket member.

5. The bucket assembly of claim 2, characterized in that the screening member (2) has means (24) for applying a flexible network mat (23) on the inside of said screening member.

6. The bucket assembly of claims 1, characterised in that each side wall (10, 10') of the screening member (2) is in the form of a grid structure.

7. The bucket assembly of claim 6, characterized in that the screening member (2) is mounted on an attachment in the form of a box girder (17) which is turnable relative to the bucket member (1) and on which are arranged two spaced-apart lugs (18, 18') articulated to the ends of hydraulic cylinders (19, 19'), the opposition end of which are articulated to analogous lugs (20, 20') on the outside of the bucket member.

8. The bucket assembly of claim 6, characterized in that the screening member (2) has means (24) for applying a flexible network mat (23) on the inside of said screening member.

9. The bucket assembly of claim 1 characterised in that the screening member (2) is mounted on an attachment in the form of a box girder (17) which is turnable relative to the bucket member (1) and on which are arranged two spaced-apart lugs (18, 18') articulated to the ends of hydraulic cylinders (19, 19'), the opposite ends of which are articulated to analogous lugs (20, 20') on the outside of the bucket member.

10. The bucket assembly of claim 9, characterized in that the screening member (2) has means (24) for applying a flexible network mat (23) on the inside of said screening member.

11. The bucket assembly of claim 1 characterised in that the screening member (2) has means (24) for applying a flexible network mat (23) on the inside of said screening member.

* * * * *